US010500627B2

(12) United States Patent
Ishizuka et al.

(10) Patent No.: US 10,500,627 B2
(45) Date of Patent: Dec. 10, 2019

(54) FORMING SYSTEM

(71) Applicant: SUMITOMO HEAVY INDUSTRIES, LTD., Tokyo (JP)

(72) Inventors: Masayuki Ishizuka, Niihama (JP); Masayuki Saika, Niihama (JP); Norieda Ueno, Yokosuka (JP); Takashi Komatsu, Oyama (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/381,681

(22) Filed: Dec. 16, 2016

(65) Prior Publication Data

US 2017/0136517 A1 May 18, 2017

Related U.S. Application Data

(63) Continuation of application No. PCT/JP2015/067503, filed on Jun. 17, 2015.

(30) Foreign Application Priority Data

Jun. 19, 2014 (JP) ..... 2014-126356
Jun. 19, 2014 (JP) ..... 2014-126360

(51) Int. Cl.
*B21D 26/00* (2006.01)
*B21D 43/00* (2006.01)
(Continued)

(52) U.S. Cl.
CPC ..... *B21D 26/033* (2013.01); *B21D 43/04* (2013.01); *B21D 43/28* (2013.01); *B21D 43/285* (2013.01); *B30B 13/00* (2013.01)

(58) Field of Classification Search
CPC ..... B21D 26/033; B21D 43/04; B21D 43/285
See application file for complete search history.

(56) References Cited

U.S. PATENT DOCUMENTS 5,396,786 A 3/1995 Bartholomew et al.
7,024,897 B2 * 4/2006 Pfaffmann ..... B21D 26/033 148/520
(Continued)

FOREIGN PATENT DOCUMENTS

CA 2104826 A1 3/1994
EP 2 172 285 A1 4/2010
(Continued)

OTHER PUBLICATIONS

International Preliminary Report on Patentability international application No. PCT/JP2015/067503 dated Dec. 20, 2016.
(Continued)

*Primary Examiner* — Teresa M Ekiert
(74) *Attorney, Agent, or Firm* — Squire Patton Boggs (US) LLP

(57) ABSTRACT

A disclosed forming system is a forming system which expands and forms a metal pipe in a die. The forming system includes a preliminary forming apparatus which preliminarily forms a metal pipe material, a forming apparatus which includes a gas supply unit which supplies gas into the preliminary-formed and heated metal pipe material to expand the metal pipe material and a main body portion to which the die is attached, and a cutting device which cuts at least a portion of the formed metal pipe. The gas supply unit is provided so as not to be disposed on a first straight line which connects the preliminary forming apparatus and the main body portion in a plan view and a second straight line which connects the cutting device and the main body portion in a plan view.

5 Claims, 9 Drawing Sheets

(51) Int. Cl.

| | |
|---|---|
| ***B21D 26/033*** | (2011.01) |
| ***B21D 43/04*** | (2006.01) |
| ***B21D 43/28*** | (2006.01) |
| ***B30B 13/00*** | (2006.01) |

(56) References Cited

U.S. PATENT DOCUMENTS

| | | | |
|---|---|---|---|
| 7,266,982 | B1 | 9/2007 | Guza |
| 2002/0003011 | A1 | 1/2002 | Dykstra et al. |

FOREIGN PATENT DOCUMENTS

| | | | |
|---|---|---|---|
| JP | H06-292929 | A | 10/1994 |
| JP | 2000-246361 | A | 9/2000 |
| JP | 2001-355765 | A | 12/2001 |
| JP | 3761820 | B2 | 3/2006 |
| JP | 2008-529798 | A | 8/2008 |
| WO | 2006/085812 | A1 | 8/2006 |
| WO | WO 2009/103335 | A1 | 8/2009 |

OTHER PUBLICATIONS

International Search Report and Written Opinion dated Jul. 21, 2015 corresponding to International Patent Application No. PCT/JP2015/067503, and English translation thereof.
Office Action dated Jan. 13, 2017 corresponding to Canadian Patent Application No. 2,952,543.
European Search Report dated Mar. 15, 2018 corresponding to European Patent Application No. 15809428.4.

* cited by examiner

FORMING SYSTEM

RELATED APPLICATIONS

Priority is claimed to Japanese Patent Application Nos. 2014-126356 and 2014-126360, filed Jun. 19, 2014, and International Patent Application No. PCT/JP2015/067503, the entire content of each of which are incorporated herein by reference.

BACKGROUND

Technical Field

Certain embodiments of the present invention relate to a forming system which forms a metal pipe.

Description of Related Art

In the related art, a forming apparatus is known, which performs forming by supplying gas into a heated metal pipe material to expand the metal pipe material. For example, in the related art, a forming apparatus includes an upper die and a lower die which are in a pair, a holding unit which holds a metal pipe material between the upper die and the lower die, and a gas supply unit which supplies gas into the metal pipe material held by the holding unit. In this forming apparatus, the metal pipe material is expanded by supplying gas into the metal pipe material in the state where the metal pipe material is held between the upper die and the lower die, and it is possible to form the metal pipe material in the shape corresponding to the shapes of the dies.

SUMMARY

According to an embodiment of the present invention, there is provided a forming system which expands and forms a metal pipe in a die, including: a preliminary forming apparatus which preliminarily forms a metal pipe material; a forming apparatus which includes a gas supply unit which supplies gas into the preliminary-formed and heated metal pipe material to expand the metal pipe material and a main body portion to which the die is attached; and a cutting device which cuts at least a portion of the formed metal pipe, in which the gas supply unit is provided so as not to be disposed on a first straight line which connects the preliminary forming apparatus and the main body portion in a plan view and a second straight line which connects the cutting device and the main body portion in a plan view.

BRIEF DESCRIPTION OF THE DRAWINGS

FIG. 4A is a view showing a state where the electrode holds a metal pipe material, FIG. 4B is a view showing a state where a seal member abuts on the electrode, and FIG. 4C is a front view of the electrode.

FIG. 5(*a*) is a view showing a state where the metal pipe material is set into the die, and FIG. 5(*b*) is a view showing a state where the metal pipe material is held by the electrode.

FIG. 7A is a view showing the metal pipe material before preliminary forming is performed, FIG. 7B is a view showing the metal pipe material after the preliminary forming is performed, FIG. 7C is a view showing the metal pipe material during forming, FIG. 7D is a view showing the metal pipe after the forming, and FIG. 7E is a view showing the metal pipe after end portions are cut.

FIG. 8A is a view showing a state where the metal pipe material is set to the blow forming die, FIG. 8B is a view showing a state when blow forming is performed, and FIG. 8C is a view showing a flange section is formed by a press.

DETAILED DESCRIPTION

Figure 1:
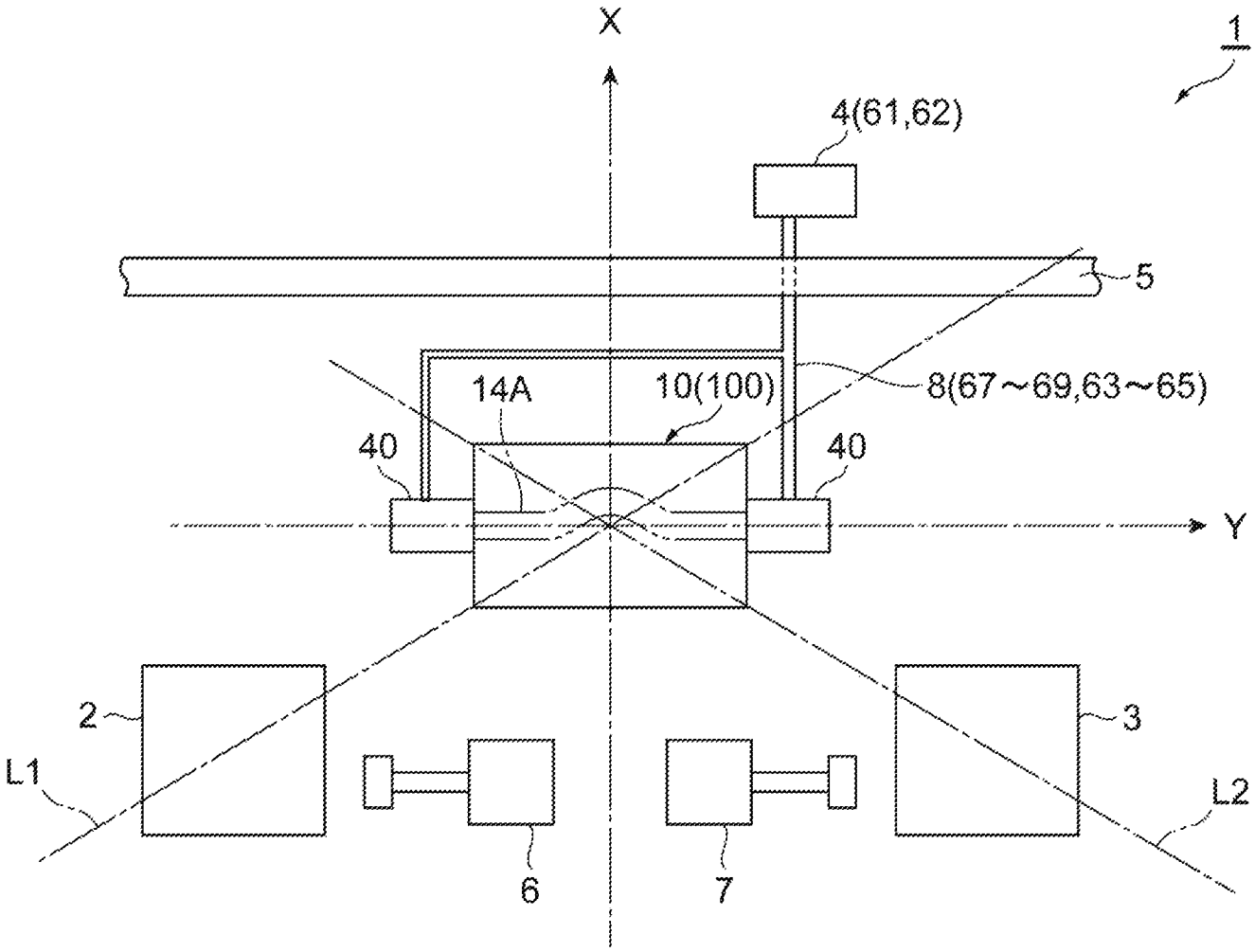
FIG. 1 is a schematic plan view of a forming system according to an embodiment of the present invention.

Here, preliminary forming such as bending is performed in advance before the metal pipe material is expanded. In addition, cutting may be performed on the expansion-formed metal pipe. In a case where a series of the preliminary forming, the forming, and cutting are continuously performed on the metal pipe material, if a gas supply unit is disposed on a path in which the metal pipe material is transported from a preliminary forming apparatus to a forming apparatus, the gas supply unit becomes an obstacle when the metal pipe material is transported. Accordingly, a method is considered in which the gas supply unit is moved so as to be largely separated from the main body portion of the forming apparatus when the metal pipe material is transported. In this case, there is a problem in that a size of a moving mechanism for moving the gas supply unit increases. In addition, time for moving largely the gas supply unit is required, and there is a problem that a forming cycle time of the metal pipe is lengthened. In a case where the gas supply unit is disposed on a path in which the formed metal pipe is transported from the forming apparatus to a cutting device, similar problems may occur.

It is desirable to provide a forming system in which a gas supply unit of a forming apparatus does not obstruct a metal pipe material which is transported from a preliminary forming apparatus to a forming apparatus and a metal pipe which is transported from the forming apparatus to a cutting device.

According to an embodiment of the present invention, the gas supply unit is provided so as not to be disposed on the first straight line which connects the preliminary forming apparatus and the main body portion in a plan view and the second straight line which connects the cutting device and the main body portion in a plan view. Accordingly, in a case where the preliminary formed metal pipe material is transported from the preliminary forming apparatus to the forming apparatus, the gas supply unit is not disposed on the first straight line which is a portion of a transport path of the metal pipe material. Therefore, the gas supply unit of the forming apparatus does not obstruct the metal pipe material which is transported from the preliminary forming apparatus to the forming apparatus. In addition, in a case where the formed metal pipe is transported from the forming apparatus to the cutting device, the gas supply unit is not disposed on the second straight line which is a portion of the transport path of the metal pipe. Accordingly, the gas supply unit of the forming apparatus does not obstruct the metal pipe which is transported from the forming apparatus to the cutting device. Therefore, according to the forming system, since it is not necessary to increase a size of a moving mechanism for moving the gas supply unit and largely move the gas supply unit, the gas supply unit does not obstruct the metal pipe material which is transported from the preliminary forming apparatus to the forming apparatus, and the metal pipe which is transported the forming apparatus to the cutting device.

In addition, in a case where horizontal directions orthogonal to each other with respect to a center of the forming apparatus are the first direction and the second direction, the preliminary forming apparatus and the cutting device may be disposed on one side in the first direction from the forming apparatus, the preliminary forming apparatus may be disposed on one side in the second direction from the forming apparatus, and the cutting device may be disposed on the other side in the second direction from the forming apparatus.

According to the forming system, the preliminary forming apparatus, the forming apparatus and the cutting device are not disposed in a row in the horizontal direction, and, for example, can be disposed in a V shape, a U shape, or the like in a plan view. Accordingly, compared to a case where the preliminary forming apparatus, the forming apparatus and the cutting device are simply disposed in a row, it is possible to decrease a site area of the forming system.

Here, a pair of the gas supply units are provided in the second direction in a state where the center of the forming apparatus is interposed between the gas supply units. In this case, for example, when the metal pipe material is transported from the preliminary forming apparatus to the forming apparatus, it is possible to dispose the preliminary forming apparatus with respect to the forming apparatus such that the pair of gas supply units which are disposed in the forming apparatus do not interfere with the metal pipe material.

In addition, the forming system may further include a handling device which transports the metal pipe material from the preliminary forming apparatus to the forming apparatus, and the handling device may be disposed on the one side in the first direction from the forming apparatus, and may be disposed between the preliminary forming apparatus and the cutting device. In this case, it is possible to dispose the handling device which transports the metal pipe material such that the transported metal pipe material does not interfere with various components such as the gas supply unit of the forming apparatus.

In addition, the forming system may further include a wall which is provided on the other side in the first direction from the forming apparatus, and a gas supply source which is provided on the other side in the first direction from the wall and supplies the gas to the gas supply unit. In this way, since the wall is disposed on the sides opposite to the preliminary forming apparatus and the cutting device in the state where the forming apparatus is interposed therebetween, it is possible to decrease a distance between the wall and the forming apparatus in the first direction. Accordingly, it is possible to further decrease the site area of the forming system.

Moreover, in a case where horizontal directions orthogonal to each other with respect to a center of the forming apparatus are the first direction and the second direction, the gas supply unit may be separated from the center of the forming apparatus and may be provided in the first direction, and the preliminary forming apparatus, the forming apparatus, and the cutting device may be disposed in the second direction.

According to this forming system, in a case where the preliminary-formed metal pipe material is transported from the preliminary forming apparatus to the forming apparatus arranged in the second direction, since the gas supply unit is not disposed on the transport path of the metal pipe material, the gas supply unit of the forming apparatus does not obstruct the metal pipe material which is transported from the preliminary forming apparatus to the forming apparatus. In addition, in a case where the formed metal pipe is transported from the forming apparatus to the cutting device arranged in the second direction, since the gas supply unit is not disposed on the transport path of the metal pipe, the gas supply unit of the forming apparatus does not obstruct the metal pipe which is transported from the forming apparatus to the cutting device. Accordingly, it is possible to dispose the gas supply unit so as to be separated from the center of the forming apparatus in the first direction, it is possible to arrange the preliminary forming apparatus, the forming apparatus, and the cutting device in the second direction orthogonal to the first direction, and it is possible to decrease the site area of the forming system.

In addition, a pair of the gas supply units may be provided in the first direction in a state where the center of the forming apparatus is interposed between the gas supply units. In this case, it is possible to dispose the preliminary forming apparatus with respect to the forming apparatus such that the pair of gas supply units do not interfere with the metal pipe material when the metal pipe material is transported from the preliminary forming apparatus to the forming apparatus. In addition, it is possible to dispose the cutting device with respect to the forming apparatus such that the pair of gas supply units do not interfere with the metal pipe when the metal pipe is transported from the forming apparatus to the cutting device.

Moreover, the preliminary forming apparatus, the forming apparatus, and the cutting device are disposed in this order in the second direction. In this case, it is possible to sequentially and continually perform a series of a preliminary forming process, a forming process, and a cutting process on the metal pipe material (metal pipe).

Hereinafter, a preferred embodiment of a forming system according to the present invention will be described with reference to the drawings. In addition, in each drawing, the same reference numerals are assigned to the same portions or the corresponding portions, and overlapping descriptions thereof are omitted.

Configuration of Forming System

FIG. 1 is a schematic plan view of a forming system of the present embodiment. As shown in FIG. 1, a forming system 1 mainly includes a preliminary forming apparatus 2 which preliminarily forms a metal pipe material, a forming apparatus 10 which forms the preliminary-formed metal pipe material, and a cutting device 3 which cuts at least a portion of the formed metal pipe. In addition to the above-described configurations, the forming system 1 includes a gas supply source 4 which supplies high-pressure gas (gas) to the forming apparatus 10, a wall 5 which is provided between the forming apparatus 10 and the gas supply source 4, a first handling device 6 which transports the preliminary-formed metal pipe material from the preliminary forming apparatus 2 to the forming apparatus 10, a second handling device 7 which transports the formed metal pipe from the forming apparatus 10 to the cutting device 3, and a path 8 through which the gas is supplied from the gas supply source 4 to the forming apparatus 10.

Figure 7A:
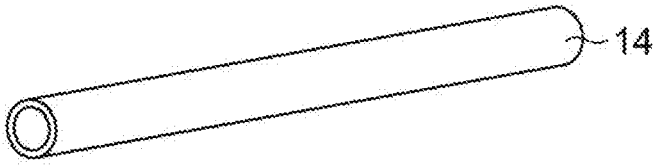
FIGS. 7A to 7E are views showing the metal pipe material and a metal pipe.
Figure 7B:
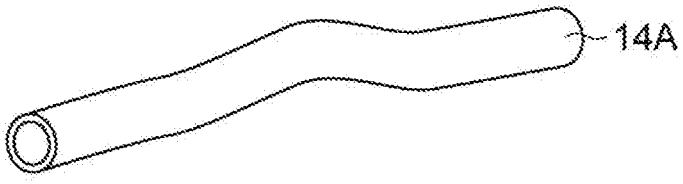
Figure 7C:
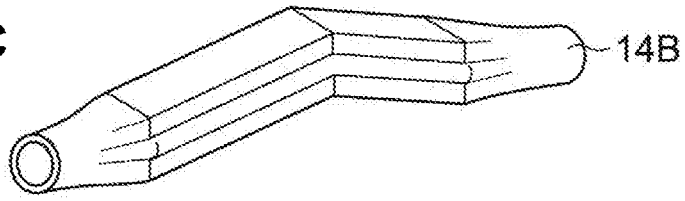

In the following descriptions, a pipe formed by the forming apparatus 10 is referred to as a metal pipe 80 (refer to as FIG. 7D), and a pipe at a step before it is formed by the forming apparatus 10 is referred to as metal pipe materials 14 to 14B (refer to FIGS. 7A to 7C). In addition, a pipe in which both end portions 80*c* and 80*d* of the metal pipe 80 are cut by the cutting device 3 is referred to as a metal pipe 90 (refer to FIG. 7E).

In addition, hereinafter, for explanation, in a plan view as shown in FIG. 1, horizontal directions orthogonal to each other with respect to the center of the forming apparatus 10 are respectively referred to as a direction X (first direction) and a direction Y (second direction). The preliminary forming apparatus 2 and the cutting device 3 are disposed one side (hereinafter, simply referred to as one side in the direction X) in the direction X from the forming apparatus 10. Moreover, the preliminary forming apparatus 2 is disposed on one side (hereinafter, simply referred to as one side in the direction Y) in the direction Y from the forming apparatus 10, and the cutting device 3 is disposed on the other side (hereinafter, simply referred to as the other side in the direction Y) in the direction Y from the forming apparatus 10. That is, the preliminary forming apparatus 2, the forming apparatus 10, and the cutting device 3 are disposed in a V shape (or U shape) in a plan view. The preliminary forming apparatus 2 and the forming apparatus 10 (for example, the center of the preliminary forming apparatus 2 and the center of the forming apparatus 10) are connected to each other by a first straight line L1 in a plan view, and the forming apparatus 10 and the cutting device 3 (for example, the center of the forming apparatus 10 and the center of the cutting device 3) are connected to each other by a second straight line L2 in plan view.

The wall 5 is provided on the other side (hereinafter, simply referred to as the other side in the direction X) in the direction X from the forming apparatus 10, and the gas supply source 4 is provided on the other side in the direction X from the wall 5.

The first handling apparatus 6 is disposed on the one side in the direction X from the forming apparatus 10 and is disposed between the preliminary forming apparatus 2 and the cutting device 3. More specifically, the first handling device 6 is disposed on the one side in the direction Y between the preliminary forming apparatus 2 and the cutting device 3. The second handling device 7 is disposed on the one side in the direction X from the forming apparatus 10 and is disposed between the first handling device 6 and the cutting device 3. More specifically, the second handling device 7 is disposed on the other side in the direction Y between the preliminary forming apparatus 2 and the cutting device 3.

The preliminary forming apparatus 2 is an apparatus which performs preliminary forming on the transported metal pipe material 14 and deforms the metal pipe material 14 into a desired shape. Here, the preliminary forming means plastic deformation performing on the metal pipe material 14 before the metal pipe 80 is formed by the forming apparatus 10. For example, as the preliminary forming, there are various plastic working such as bending or embossing. In the present embodiment, the preliminary forming apparatus 2 performs bending (prebending) at a predetermined position of the metal pipe material 14. Accordingly, for example, the preliminary forming apparatus 2 includes a component for holding the metal pipe material 14, a component which applies a pressure to the held metal pipe material 14 so as to bend the metal pipe material 14, or the like.

The forming apparatus 10 is an apparatus which deforms the preliminary-formed metal pipe material 14A (refer to FIG. 7B) into a desired shape using a blow forming die (die) 13 (refer to FIG. 2) attached to a main body portion 100 so as to obtain the metal pipe 80. The forming apparatus 10 includes a pipe holding mechanism 30 (refer to FIG. 2) which holds the end portion of the metal pipe material 14A, and a pair of gas supply mechanisms (gas supply units) 40 and 40 which supply gas to the metal pipe material 14A so as to expand the metal pipe material 14A. The pair of gas supply mechanisms 40 and 40 are disposed in the direction Y in the state where the center of the forming apparatus 10 is interposed therebetween. Each of the pair of gas supply mechanisms 40 and 40 is connected to the gas supply source 4 via the path 8. Each of the pair of gas supply mechanisms 40 and 40 is not disposed on the first straight line L1 and the second straight line L2 shown in FIG. 1. Details of the further configurations of the forming apparatus 10 and details of the forming method performed by the forming apparatus 10 will be described below. However, the center of the main body portion 100 in a plan view overlaps the center of the forming apparatus 10 in a plan view.

The cutting device 3 is a device which cuts at least a portion of the formed metal pipe 80 so as to obtain the metal pipe 90. For example, as a method for cutting the metal pipe 80 by the cutting device 3, there are various cutting such as laser processing, press processing, or wire cutting processing. In the present embodiment, the cutting device 3 radiates end portions 80*c* and 80*d* (refer to FIG. 7D) of the metal pipe 80 which are not formed with laser to cut the end portions 80*c* and 80*d*. For example, the metal pipe 90 which is formed by the laser cutting is subjected to a grinding or the like so as to be shipped as a product.

The gas supply source 4 is a device which supplies high-pressure gas to the pair of gas supply mechanisms 40 and 40 via the path 8. For example, the gas supply source 4 includes a compressor and an air tank, and performs the forming of the metal pipe material 14A installed in the forming apparatus 10 using the high-pressure gas supplied by the gas supply source 4 (the details will be described below). For example, the high-pressure gas uses high-pressure air, high-pressure nitrogen, or the like.

The wall 5 is installed between the forming apparatus 10 and the gas supply source 4 in the direction X, and is a concrete wall which extends in the direction Y. Since the wall 5 is disposed on the sides opposite to the preliminary forming apparatus 2 and the cutting device 3 in the state where the forming apparatus 10 is interposed therebetween, it is possible to decrease the distance between the wall 5 and the forming apparatus 10 in the direction X. For example, the wall 5 can be used as a protective wall when the forming apparatus 10 or the gas supply source 4 is damaged.

The first handling device 6 is a device which transports the metal pipe material 14A from the preliminary forming apparatus 2 to the forming apparatus 10. For example, as the first handling device 6, a robot arm having multi axes, a transfer feeder, or the like is used. In the present embodiment, from the viewpoint from the metal pipe material 14A being installed at a predetermined position in the forming apparatus 10, a robot arm is used. When the first handling device 6 transports the metal pipe material 14A, the first handling device 6 is disposed such that the metal pipe material 14A does not come into contact with or does not interfere with one gas supply mechanism 40 of the forming apparatus 10.

The second handling device 7 is a device which transports the metal pipe 80 from the forming apparatus 10 to the cutting device 3. For example, as the second handling device 7, a robot arm having multi axes, a transfer feeder, or the like is used. In the present embodiment, from the viewpoint from the metal pipe 80 being installed at a predetermined position in the cutting device 3, a robot arm is used. The second handling device 7 is disposed such the other gas supply mechanism 40 of the forming apparatus 10 does not obstruct the transported metal pipe 80.

Configuration of Forming Apparatus and Blow Mechanism

Figure 2:
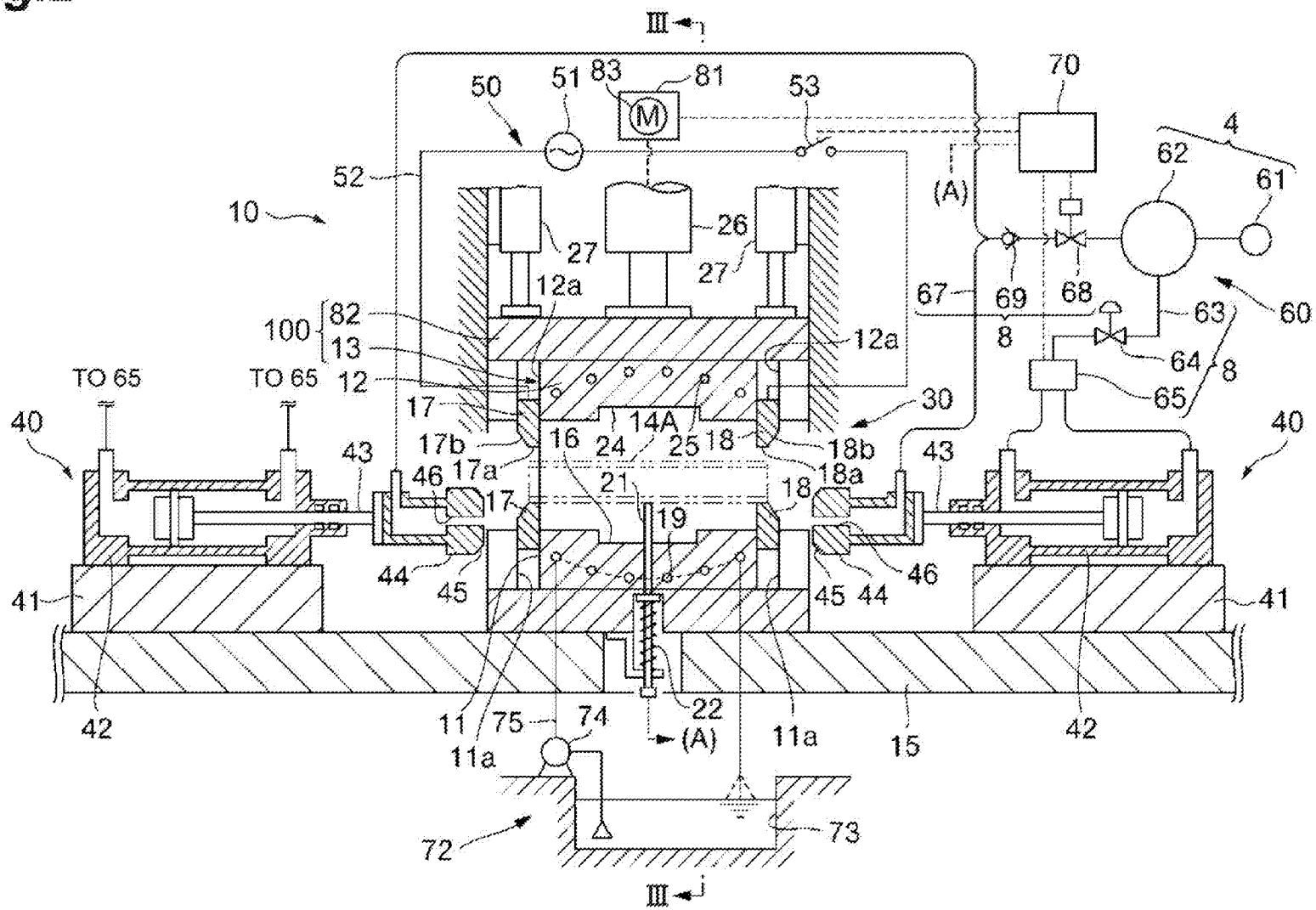
FIG. 2 is a schematic configuration view of a forming apparatus and a blow mechanism.

FIG. 2 is a schematic configuration view of the forming apparatus and a blow mechanism. As shown in FIG. 2, the forming apparatus 10 forming the metal pipe 80 is configured of a blow forming die 13 which includes the upper die 12 and the lower die 11, a slider 82 which moves at least one of the upper die 12 and the lower die 11, a drive section 81 which generates a drive force for moving the slider 82, a pipe holding mechanism 30 which holds the metal pipe material 14A between the upper die 12 and the lower die 11, the pair of gas supply mechanisms 40 which supply high-pressure gas (gas) into the metal pipe material 14A which is held by the pipe holding mechanism 30, a heating mechanism (heating unit) 50 which supplies power to the metal pipe material 14A held by the pipe holding mechanism 30 to heat the metal pipe material 14A, a control unit 70 which controls the operations of the drive section 81, the pipe holding mechanism 30, and the blow forming die 13, and the heating mechanism 50, and a water circulation mechanism 72 which forcedly cools the blow forming die 13 with water. In addition, the pair of gas supply mechanisms 40 and 40 are connected to a blow mechanism 60 which supplies high-pressure gas.

The control unit 70 controls a series of controls such as a control for closing the blow forming die 13 when the metal pipe material 14A is heated to a quenching temperature (AC3 transformation point temperature or more) or a control for blowing high-pressure gas into the heated metal pipe material 14A. Accordingly, the control unit 70 controls the operation of the blow mechanism 60 in addition to the operation of the pipe holding mechanism 30, the heating mechanism 50, or the like.

Figure 4A:
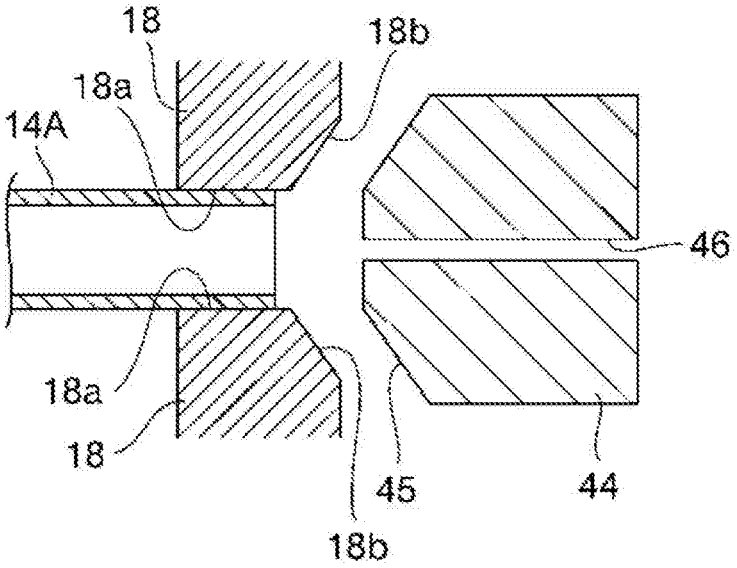
FIGS. 4A to 4C are enlarged views around an electrode.
Figure 4B:
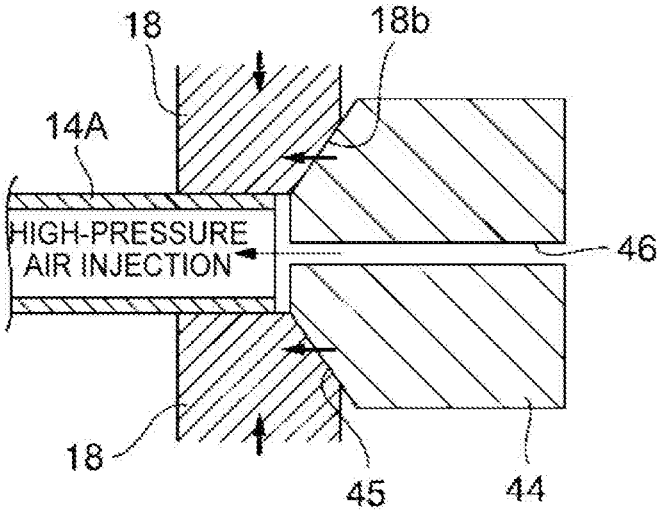
Figure 4C:
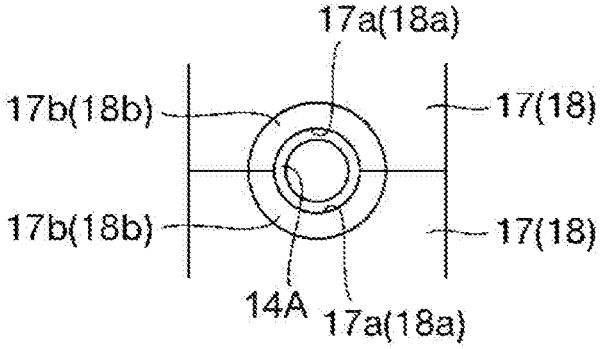

The lower die 11 is fixed to a large base 15. The lower die 11 is configured of a large steel block, and includes a cavity (recessed portion) 16 on the upper surface thereof. In addition, electrode accommodation spaces 11*a* are provided around the right and left ends (right and left ends in FIG. 1) of the lower die 11, and a first electrode 17 and a second electrode 18 which are configured so as to be movable upward and downward by an actuator (not shown) are provided in the electrode accommodation spaces 11*a*. Semicircular recessed grooves 17*a* and 18*a* corresponding to the lower outer peripheral surface of the metal pipe material 14A are respectively formed on the upper surfaces of the first electrode 17 and the second electrode 18 (refer to FIG. 4C), and the metal pipe material 14A can be disposed so as to be exactly fitted to the portions of the recessed grooves 17*a* and 18*a*. In addition, a taper recessed surface 17*b* in which the vicinity is inclined in a taper shape toward the recessed groove 17*a* so as to be recessed is formed on the front surface (the surface in the outside direction of the die) of the first electrode 17, and a taper recessed surface 18*b* in which the vicinity is inclined in a taper shape toward the recessed groove 18*a* so as to be recessed is formed on the front surface of the second electrode 18. In addition, a cooling water passage 19 is formed in the lower die 11, and a thermocouple 21 which is inserted from the lower portion is provided at the approximately center of the lower die 11. The thermocouple 21 is supported to be movable upward and downward by a spring 22.

Moreover, the pair of first electrode 17 and second electrode 18 positioned on the lower die 11 side configure the pipe holding mechanism 30, and can liftably support the metal pipe material 14A between the upper die 12 and the lower die 11. In addition, the thermocouple 21 only is an example of temperature measurement means, and may be a non-contact type temperature sensor such as a radiation thermometer or an optical thermometer. Moreover, the temperature measurement means may be omitted as long as a relationship between a power-supply time and a temperature can be obtained.

The upper die 12 includes a cavity (recessed portion) 24 on the lower surface of the upper die and is a steel block in which the cooling water passage 25 is built. The upper end portion of the upper die 12 is fixed to the slider 82. In addition, the slider 82 to which the upper die 12 is fixed is suspended by a pressurization cylinder 26, and is guided such that the upper die 12 is not laterally swung by guide cylinders 27. The drive section 81 according to the present embodiment includes a servo motor 83 which generates a drive force for driving the slider 82. The drive section 81 is configured of a fluid supply unit which supplies a fluid (a working fluid in a case where a hydraulic cylinder is adopted as the pressurization cylinder 26) driving the pressurization cylinder 26 to the pressurization cylinder 26.

As described above, since the blow forming die 13 is attached to the main body portion 100, the main body portion 100 of the forming apparatus 10 includes at least the base 15 and the slider 82.

The control unit 70 controls the amount of the fluid which is supplied to the pressurization cylinder 26 by controlling the servo motor 83 of the drive section 81. Accordingly, it is possible to control the movement of the slider 82. In addition, as described above, the drive section 81 is not limited to the drive section which applies the drive force to the slider 82 via the pressurization cylinder 26. For example, the drive section 81 may be mechanically connected to the slider 82 and may directly or indirectly apply the drive force generated by the servo motor 83 to the slider 82. For example, the drive section 81 may adopt a drive mechanism which includes, an eccentric shaft, a drive source (for example, a servo motor, a speed reducer, or the like) which applies a rotating force rotating the eccentric shaft and a conversion unit (for example, a connecting rod, an eccentric sleeve, or the like) which converts a rotation movement of the eccentric shaft into a linear movement so as to move a slider. In addition, in the present embodiment, only the upper die 12 moves. However, the lower die 11 may move in addition to the upper die 12 or instead of the upper die 12. Moreover, in the present embodiment, the drive section 81 may not include the servo motor 83.

In addition, similarly to the lower die 11, the first electrode 17 and the second electrode 18 which are configured so as to be movable upward and downward by an actuator (not shown) are provided in electrode accommodation spaces 12*a* provided around the right and left ends (right and left ends in FIG. 2) of the upper die 12. Semicircular recessed grooves 17*a* and 18*a* corresponding to the upper outer peripheral surface of the metal pipe material 14A are respectively formed on the lower surfaces of the first electrode 17 and the second electrode 18 (refer to FIG. 4C), and the metal pipe material 14A can be exactly fitted to the recessed grooves 17*a* and 18*a*. In addition, the taper recessed surface 17*b* in which the vicinity is inclined in a taper shape toward the recessed groove 17*a* so as to be recessed is formed on the front surface (the surface in the outside direction of the die) of the first electrode 17, and the taper recessed surface 18*b* in which the vicinity is inclined in a taper shape toward the recessed groove 18*a* so as to be recessed is formed on the front surface of the second electrode 18. Accordingly, the pair of first and second mechanisms 17 and 18 positioned on the upper die 12 side configure the pipe holding mechanism 30, and if the metal pipe material 14A is interposed in the vertical direction by the pair of first and second electrodes 17 and 18 which are positioned on the upper side and the lower side, the holding mechanism 30 is configured so as to surround the metal pipe material 14A to exactly come into close contact with the entire outer circumference of the metal pipe material 14A.

Figure 3A:
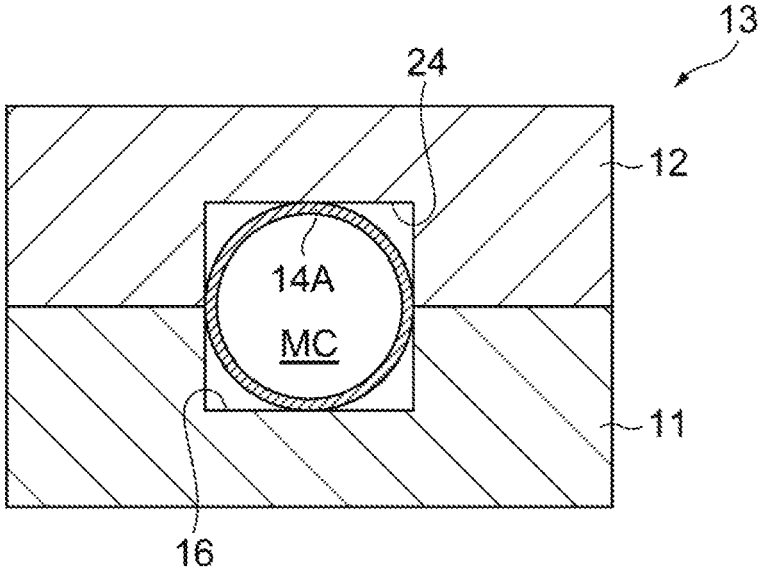
FIGS. 3A and 3B are sectional views taken along line III-III shown in FIG. 2, and are schematic sectional views of a blow forming die.
Figure 3B:
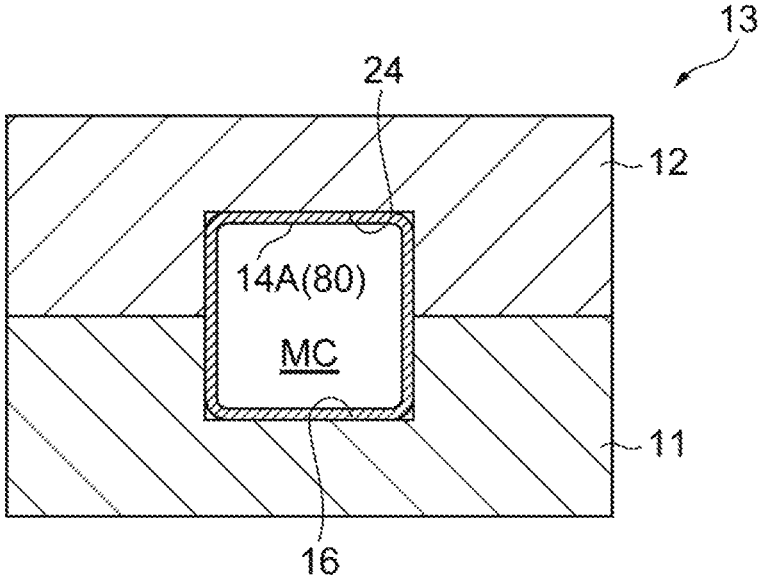

FIGS. 3A and 3B are schematically sectional views when the blow forming die 13 is viewed from the side surface direction. FIGS. 3A and 3B are sectionals view of the blow forming die 13 taken along line III-III in FIG. 2, and shows a state of the position of the die when blow forming is performed. As shown in FIGS. 3A and 3B, the rectangular cavity 16 is formed on the upper surface of the lower die 11. The rectangular cavity 24 is formed on the lower surface of the upper die 12 at the position facing the cavity 16 of the lower die 11. In a state where the blow forming die 13 is closed, the cavity 16 of the lower die 11 and the cavity 24 of the upper die 12 are combined, and a main cavity portion MC which is a rectangular space is formed. As shown in FIG. 3A, the metal pipe material 14A which is disposed in the main cavity portion MC comes into contact with the inner wall surface of the main cavity portion MC as shown in FIG. 3B by expansion, and is formed in the shape (here, the cross section is a rectangular shape) of the main cavity portion MC.

As shown in FIG. 2, each of the pair of gas supply mechanisms 40 includes a cylinder unit 42, a cylinder rod 43 which moves backward according to the operation of the cylinder unit 42, and a seal member 44 which is connected to the tip on the pipe holding mechanism 30 side in the cylinder rod 43. The cylinder unit 42 is disposed to be fixed to the base 15 via a block 41. A taper surface 45 which is tapered is formed on the tip of each seal member 44. One taper surface 45 is formed in a shape which can be exactly fitted to abut on the taper recessed surface 17*b* of the first electrode 17, and the other taper surface 45 is formed in a shape which can be exactly fitted to abut on the taper recessed surface 18*b* of the second electrode 18 (refer to FIGS. 4A to 4C). A gas passage 46 which extends from the cylinder unit 42 side toward the tip and through which high-pressure gas supplied from the blow mechanism 60 flows is provided in the seal member 44.

The heating mechanism 50 includes a power source 51, a lead wire 52 which extends from the power source 51 and is connected to the first electrode 17 and the second electrode 18, and a switch 53 which is provided in the intermediate of the lead wire 52. Information is transmitted from (A) to the control unit 70, and the control unit 70 acquires temperature information from the thermocouple 21 and controls the pressurization cylinder 26, the switch 53, or the like.

The water circulation mechanism 72 includes a water tank 73 in which water is collected, a water pump 74 which pumps and pressurizes the water collected in the water tank 73 and feeds the water to the cooling water passage 19 of the lower die 11 and the cooling water passage 25 of the upper die 12, and a pipe 75. Although it is omitted, a cooling tower which decreases the temperature of water or a filter which purifies water may be provided in the pipe 75.

The blow mechanism 60 includes a high-pressure gas source 61, an accumulator 62 in which the high-pressure gas supplied from the high-pressure gas source 61 is accumulated, a first tube 63 which extends from the accumulator 62 to the cylinder unit 42, a pressure control valve 64 and a switching valve 65 which are provided in the intermediate of the first tube 63, a second tube 67 which extends from the accumulator 62 to the gas passage 46 formed in the seal member 44, and an on-off valve 68 and a check valve 69 which are provided in the intermediate of the second tube 67. In addition, the gas supply source 4 shown in FIG. 1 is configured of the high-pressure gas source 61 and the accumulator 62 in the blow mechanism 60. In addition, the path 8 shown in FIG. 1 is configured of the second tube 67, the on-off valve 68, and the check valve 69 in the blow mechanism 60. In the present embodiment, the path 8 includes the first tube 63, the pressure control valve 64, and the switching valve 65.

The pressure control valve 64 plays a role of supplying high-pressure gas having an operation pressure according to the pushing force required from the seal member 44 side to the cylinder unit 42. The check valve 69 plays a role of preventing the high-pressure gas in the second tube 67 from flowing backward. The switching valve 65, the on-off valve 68, or the like is controlled by the control unit 70.

Operation of Forming System

Figure 5A:
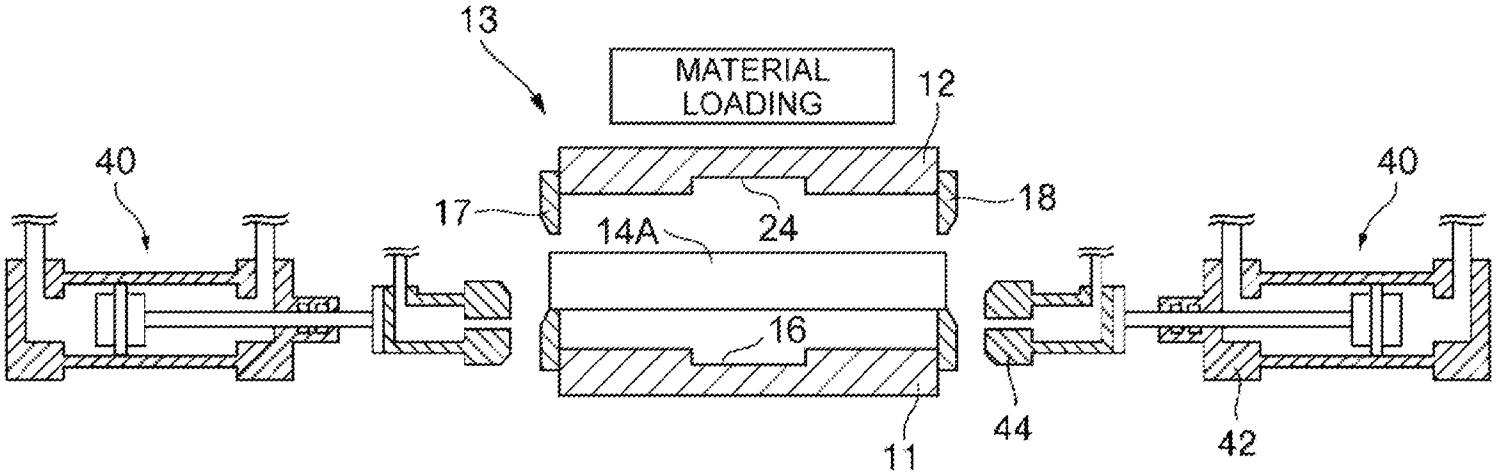
FIGS. 5A-5B are views showing a manufacturing process performed by the forming apparatus.
Figure 5B:
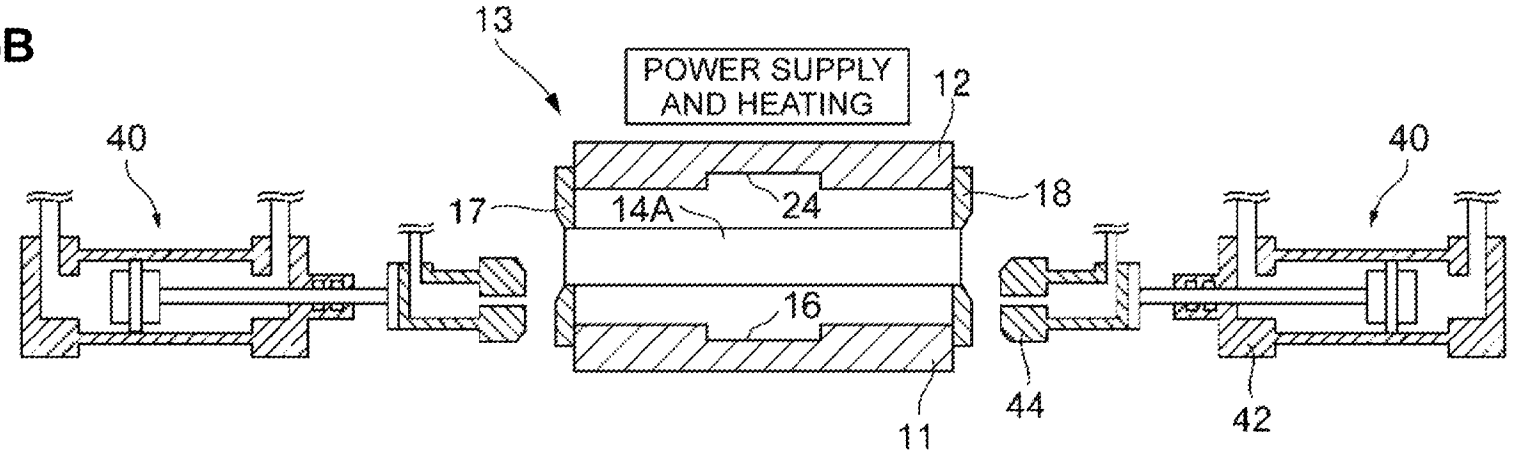

Next, the operation of the forming system 1 will be described. FIGS. 5A and 5B show a pipe loading process in which the metal pipe material 14A which is a material is loaded from a power-supply and heating process in which power is supplied to the metal pipe material 14A so as to heat the metal pipe material 14A. First, the metal pipe material 14 (refer to FIG. 7A) which is a kind of steel to which quenching can be applied is prepared. The metal pipe material 14 is held by the preliminary forming apparatus 2, the metal pipe material 14 is bent, and the metal pipe material 14A is obtained (refer to FIG. 7B). As shown in FIG. 5(*a*), the metal pipe material 14A is disposed on the first and second electrodes 17 and 18 provided in the lower die 11 side by the first handling device 6 (refer to FIG. 1). Since the recessed grooves 17*a* and 18*a* are respectively formed on the first and second electrodes 17 and 18, the metal pipe material 14A is positioned by the recessed grooves 17*a* and 18*a*. Next, the control unit 70 (refer to FIG. 2) controls the pipe holding mechanism 30 and holds the metal pipe material 14A by the pipe holding mechanism 30. Specifically, as shown in FIG. 5(*b*), the control unit 70 operates an actuator (not shown) which can move the first electrode 17 and the second electrode 18 forward and backward, and causes the first and second electrodes 17 and 18 to approach and abut on the first and second electrodes 17 and 18 positioned vertically. Due to this abutment, both end portions of the metal pipe material 14A are held by the first and second electrodes 17 and 18 in the vertical direction. In addition, the holding is performed such that the first and second electrodes 17 and 18 come into close-contact with the entire circumference of the metal pipe material 14A due to the existences of the recessed grooves 17*a* and 18*a* which are respectively formed on the first and second electrodes 17 and 18. However, the present invention is not limited to the configuration in which the first and second electrodes 17 and 18 come into close-contact with the entire circumference of the metal pipe material 14A. The first and second electrodes 17 and 18 may abut on a portion of the metal pipe material 14A in the circumferential direction.

Subsequently, as shown in FIG. 2, the control unit 70 controls the heating mechanism 50 so as to heat the metal pipe material 14A. Specifically, the control unit 70 turns on the switch 53 of the heating mechanism 50. Accordingly, power is supplied from the power source 51 to the metal pipe material 14A, and the metal pipe material 14A itself emits heat (joule heat) due to resistance existing in the metal pipe material 14A. At this time, the measurement value of the thermocouple 21 is always observed, and power supply is controlled based on the measured result.

Figure 6:
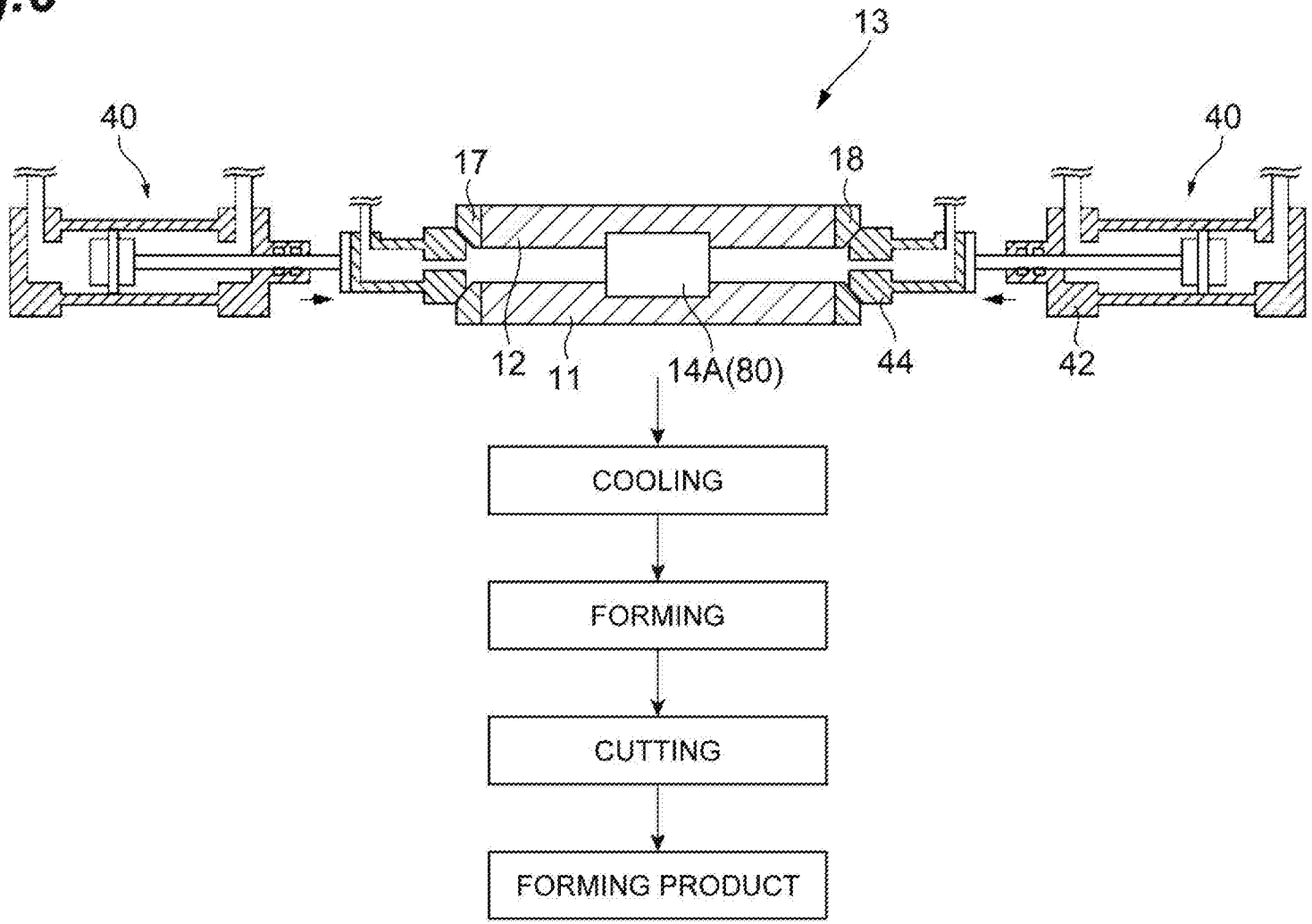
FIG. 6 is a view showing a blow forming process performed by the forming apparatus and a flow after the blow forming process.

FIG. 6 shows the blow forming process performed by the forming apparatus and the flow after the blow forming process. As shown in FIG. 6, the blow forming die 13 is closed to the heated metal pipe material 14A, and the metal pipe material 14A is disposed and sealed in the cavity of the blow forming die 13. Thereafter, both ends of the metal pipe material 14A are sealed by the seal members 44 by operating the cylinder units 42 of the gas supply mechanisms 40 (also referred to as FIGS. 4A to 4C). After the sealing is completed, high-pressure gas is blown into the metal pipe material 14A, the metal pipe material 14A which is softened by heating is deformed according to the shape of the cavity, and the metal pipe material 14B is obtained.

The metal pipe material 14A is heated at a high temperature (approximately 950° C.) so as to be softened, and can be blow-formed at a relatively low pressure. Specifically, in a case where a compressed air having a normal temperature (25° C.) at 4 MPa is adopted as the high-pressure gas, the compressed air is heated to approximately 950° C. in the sealed metal pipe material 14A. The compressed air is thermally expanded, and the pressure of the compressed air reaches approximately 16 to 17 MPa based on a Boyle Charles' law. That is, the metal pipe material 14A of 950° C. is easily expanded by the compressor air which is thermally expanded, and it is possible to obtain the metal pipe 80 via the metal pipe material 14B.

The outer peripheral surface of the metal pipe material 14B which is blow-formed and expanded comes into contact with the cavity 16 of the lower die 11 and is rapidly cooled, and simultaneously, comes into contact with the cavity 24 of the upper die 12, is rapidly cooled (since the heat capacities of the upper die 12 and the lower die 11 are great and the upper die 12 and the lower die 11 are maintained so as to be low temperatures, if the metal pipe material 14B comes into contact with the upper die 12 and the lower die 11, the heat on the surface of the pipe is transmitted to the die side at once) and is subjected to quenching. This cooling method is referred to as die contact cooling or die cooling. Immediately after the metal pipe material 14B is rapidly cooled, austenite is transformed to martensite. Since a cooling speed decreases at the latter half of the cooling, martensite is transformed to another structure (troosite, sorbite, or the like) by radiation heat. Accordingly, it is not necessary to separately perform tempering processing. In addition, in the present embodiment, cooling is performed by supplying a cooling medium to the metal pipe 80 instead of the die cooling or in addition to the die cooling.

Figure 7D:
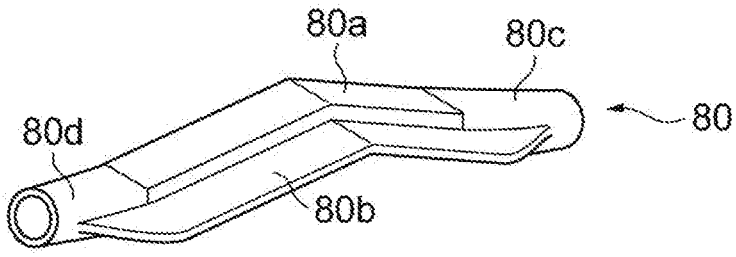
Figure 7E:
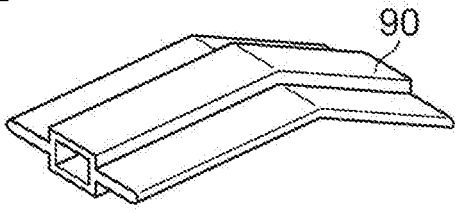

As described above, the cooling is performed after the blow forming is performed on the metal pipe material 14A, the die is opened, and the metal pipe 80 having an approximately rectangular pipe unit 80*a* and a flat plate-shaped flange section 80*b* is obtained (refer to FIG. 7D).

Next, with reference to FIGS. 8A to 8C, the aspect of the forming performed by the upper die 12 and the lower die 11 will be described in detail. In addition, in the descriptions below, the portion corresponding to each of the pipe units 80*a* of the metal pipe material 14B during the forming and the metal pipe 80 before the blow forming die 13 is opened is referred to as a "first forming unit 14*a*", and the portion corresponding to the flange section 80*b* is referred to as a "second forming unit 14*b*".

Figure 8A:
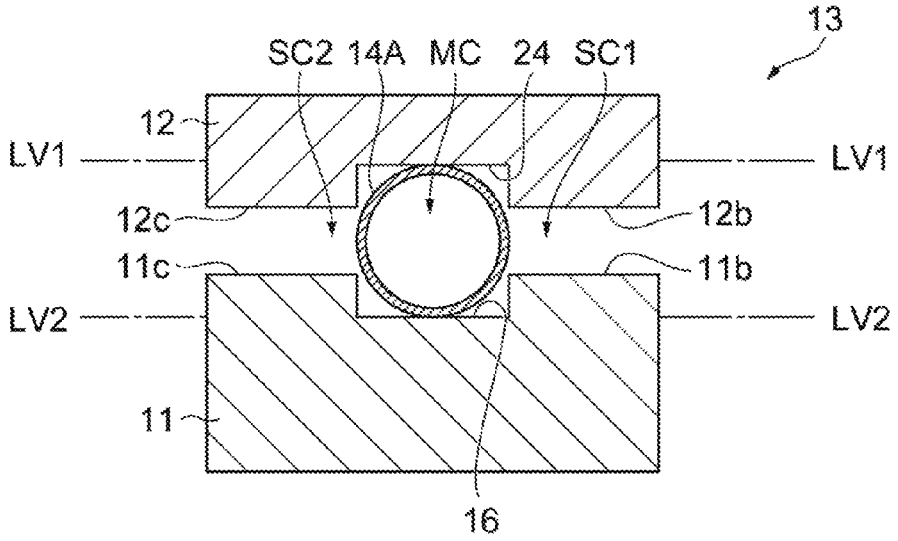
FIGS. 8A to 8C are views showing another example of the operation of the blow forming die and a change of the shape of the metal pipe material.
Figure 8B:
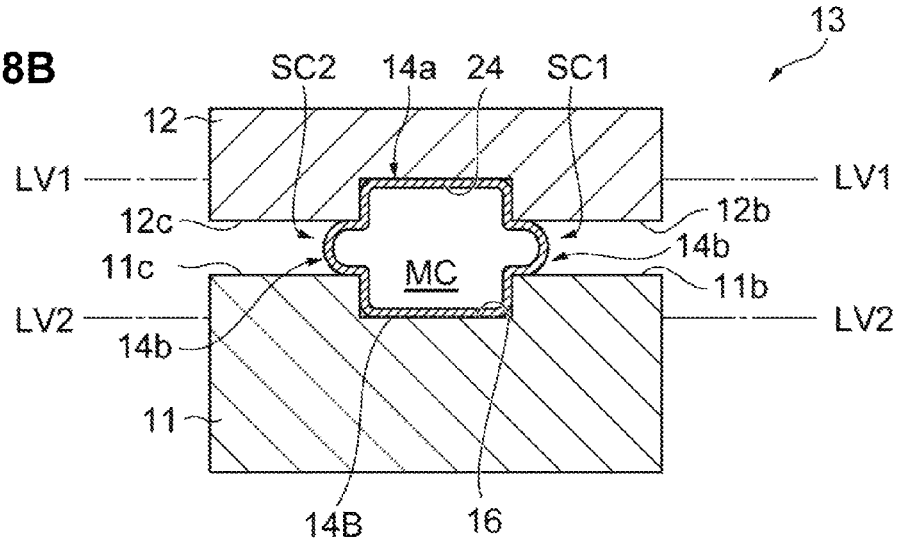

As shown in FIGS. 8A and 8B, in the forming apparatus 10 according to the present embodiment, the blow forming is not performed in the state where the upper die 12 and the lower die 11 are completely closed (clamped). That is, since a constant separation state is maintained, the blowing forming is performed in a state where sub cavity portions SC1 and SC2 are formed beside the main cavity portion MC. In this state, the main cavity portion MC is formed between the surface on a reference line LV1 of the cavity 24 and the surface on the reference line LV2 of the cavity 16. In addition, a sub cavity portion SC1 is formed between the surface of a first protrusion 12*b* outside the main cavity portion MC in the upper die 12 and the surface of a first protrusion 11*b* outside the main cavity portion MC in the lower die 11. Similarly, a sub cavity portion SC2 is formed between the surface of a second protrusion 12*c* outside the main cavity portion MC in the upper die 12 and the surface of a second protrusion 11*c* outside the main cavity portion MC in the lower die 11. The main cavity portion MC and the sub cavity portions SC1 and SC2 communicate with each other. In addition, in the present embodiment, the surface of the first protrusion 12*b* of the upper die 12 configuring the sub cavity portion SC1 and the surface of the first protrusion 11*b* of the lower die 11 extend to the end portions (the right sides in a paper surface in each of FIGS. 8A to 8C) of the upper die 12 and the lower die 11 in the width direction in a state of being separated from each other in the vertical direction. Similarly, the surface of the second protrusion 12*c* of the upper die 12 configuring the sub cavity portion SC2 and the surface of the second protrusion 11*c* of the lower die 11 extend to the end portions (the left sides in a paper surface in each of FIGS. 8A to 8C) of the upper die 12 and the lower die 11 in the width direction in a state of being separated from each other in the vertical direction. Accordingly, the sub cavities SC1 and SC2 communicate with the outside of the die. As a result, as shown in FIG. 8B, the metal pipe material 14B which is softened by heating and into which high-pressure gas is injected enter not only the main cavity portion MC but also the sub cavity portions SC1 and SC2, and is expanded.

Figure 8C:
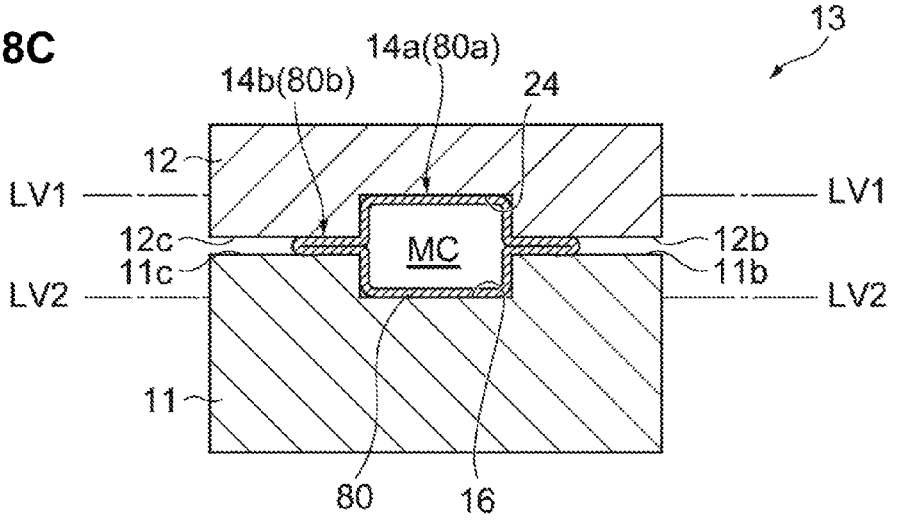

In the example shown in FIGS. 8A to 8C, since the main cavity portion MC is configured to have a rectangular cross section, the metal pipe material 14A is blow-formed according to the shape and is formed in a tubular shape having a rectangular cross section. In addition, the portion corresponds to the first forming unit 14*a* which becomes a pipe unit 80*a*. However, the shape of the main cavity portion MC is not particularly limited. All sectional shapes such as a circular cross section, an elliptical cross section, or a polygonal cross section may be adopted according to a desired shape. In addition, since the main cavity portion MC and the sub cavity portions SC1 and SC2 communicate with each other, a portion of the metal pipe material 14B enters the sub cavity portions SC1 and SC2. The portion corresponds to the second forming unit 14*b* which becomes the flange section 80*b* by crushing.

As shown in FIG. 8C, at the step after the blow forming or the step during the blow forming, the upper die 12 and the lower die 11 separated from each other approach each other. According to this operation, volumes of the sub cavity portions SC1 and SC2 decrease, the internal space of the second forming unit 14*b* decreases, and the second forming unit 14*b* is folded. That is, according to approaching between the upper die 12 and the lower die 11, the forming unit 14*b* of the metal pipe material 14B entering the sub cavity portions SC1 and SC2 is pressed and crushed. As a result, the second forming unit 14*b* which is crushed in the longitudinal direction of the metal pipe material 14B is formed on the outer peripheral surface of the metal pipe material 14B. In addition, the time until the press forming of the flange section 80*b* is completed from the blow forming is dependent on the kind of the metal pipe material 14. However, the press forming of the flange section 80*b* is completed at approximately 1 to 2 seconds.

In the example shown in FIGS. 8A to 8C, a gap corresponding to the thickness of the crushed second forming unit 14*b* (that is, flange section 80*b*) is formed between the surface of the first protrusion 12*b* of the upper die 12 and the surface of the first protrusion 11*b* of the lower die 11 configuring the sub cavity portion SC1. Similarly, a gap corresponding to the thickness of the crushed second forming unit 14*b* (that is, flange section 80*b*) is formed between the surface of the second protrusion 12*c* of the upper die 12 and the surface of the second protrusion 11*c* of the lower die 11 configuring the sub cavity portion SC2. Even in this state, the sub cavity portions SC1 and SC2 communicate with the outside of the die. That is, in the example shown in FIGS. 8A to 8C, when the flange section 80*b* (second forming unit 14*b* of the metal pipe material 14B) of the metal pipe 80 is formed, the sub cavity portions SC1 and SC2 communicate with the outside of the die from forming starting to forming completion. Accordingly, since air in the sub cavity portions SC1 and SC2 can be extracted to the outside of the die from the forming starting to the forming completion, it is possible to improve quality of a forming product.

Moreover, since the upper die 12 and the lower die 11 approach each other after the blow forming, not only the second forming unit 14*b* of the metal pipe material 14B entering the sub cavity portions SC1 and SC2 but also the first forming unit 14*a* of the metal pipe material 14B of the main cavity portion MC are crushed. Since the metal pipe material 14B is heated and softened, by adjusting a closing speed of the die or the pressurized gas, it is possible to finish the metal pipe 80 without loosening or distortion.

In addition, in the obtained metal pipe 80, the metal pipe 80 is transferred from the forming apparatus 10 to the cutting device 3 using the second handling device 7. Both end portions 80*c* and 80*d* of the metal pipe 80 which are not expanded are cut by the cutting device 3, and the metal pipe 90 which is a forming product is obtained (refer to FIG. 7E).

In this way, according to the forming system 1 which performs a series of processing, both of the pair of gas supply mechanisms 40 and 40 are provided so as not to be disposed on the first straight line L1 which connects the preliminary forming apparatus 2 and the main body portion 100 of the forming apparatus 10 to each other in a plan view and the second straight line L2 which connects the cutting device 3 and the main body portion 100 to each other in a plan view. Accordingly, in the case where the preliminary-formed metal pipe material 14A is transported from the preliminary forming apparatus 2 to the main body portion 100, the gas supply mechanisms 40 and 40 are not disposed on the first straight line L1 which is a portion of the transport path of the metal pipe material 14A. Accordingly, the supply mechanisms 40 and 40 of the forming apparatus 10 do not obstruct the metal pipe material 14A which is transported from the preliminary forming apparatus 2 to the forming apparatus 10. In addition, in the case where the formed metal pipe 80 is transported from the forming apparatus 10 to the cutting device 3, the gas supply mechanisms 40 and 40 are not disposed on the second straight line L2 which is a portion of the transport path of the metal pipe 80. Accordingly, the supply mechanisms 40 and 40 of the forming apparatus 10 do not obstruct the metal pipe 80 which is transported from the forming apparatus 10 to the cutting device 3. Therefore, according to the forming system 1, since it is not necessary to increase the size of the cylinder unit 42 which is the moving mechanism for moving the gas supply mechanisms 40 and 40 or the like and it is not necessary to largely move the cylinder rods 43 of the gas supply mechanisms 40 and 40 or the like, the gas supply mechanisms 40 and 40 of the forming apparatus 10 do not obstruct the metal pipe material 14A which is transported from the preliminary forming apparatus 2 to the forming apparatus 10 and the metal pipe 80 which is transported from the forming apparatus 10 to the cutting device 3.

In addition, the preliminary forming apparatus 2 and the cutting device 3 are disposed on the one side in the direction X from the forming apparatus 10, the preliminary forming apparatus 2 is disposed on the one side in the direction Y from the forming apparatus 10, and the cutting device 3 is disposed on the other side in the direction Y from the forming apparatus 10. In this case, the preliminary forming apparatus 2, the forming apparatus 10, and the cutting device 3 are not disposed in a row in the horizontal direction, and is disposed in a V shape, a U shape, or the like in a plan view. As a specific example, in a case where the preliminary forming apparatus 2, the forming apparatus 10, and the cutting device 3 are simply disposed in a row, the maximum length in the longitudinal direction (direction Y) of the region occupied by the forming system in a plan view is approximately 21 m, the maximum length in a transverse direction (direction X) of the region is approximately 13 m, and an area which is obtained by multiplying the lengths is approximately 273 $m^2$. Meanwhile, the maximum length in the longitudinal direction of the region occupied by the forming system 1 according to the present invention in a plan view is approximately 17.5 m, the maximum length in the transverse direction of the region is approximately 14 m, and the area is approximately 245 $m^2$. That is, compared to the case where the preliminary forming apparatus 2, the forming apparatus 10, and the cutting device 3 are simply disposed in a row, it is possible to decrease the site area of the forming system 1 in the present embodiment.

In addition, the pair of gas supply mechanisms 40 and 40 are provided in the direction Y in a state where the center of the forming apparatus 10 is interposed therebetween. Accordingly, when the metal pipe material 14A is transported from the preliminary forming apparatus 2 to the forming apparatus 10, it is possible to dispose the preliminary forming apparatus 2 with respect to the forming apparatus 10 such that the pair of gas supply mechanisms 40 and 40 do not interfere with the metal pipe material 14A.

Moreover, the forming system 1 includes the first handling device 6 which transports the metal pipe material 14A from the preliminary forming apparatus 2 to the forming apparatus 10, the first handling device 6 is disposed on the one side in the direction X from the forming apparatus 10 and is disposed between the preliminary forming apparatus 2 and the cutting device 3. Accordingly, it is possible to dispose the first handling device 6 transporting the metal pipe material 14A such that the transported metal pipe material 14A does not interfere with one gas supply mechanism 40 of the forming apparatus 10. Similarly, the forming system 1 includes the second handling device 7 which transports the metal pipe 80 from the forming apparatus 10 to the cutting device 3, the second handling device 7 is disposed on the one side in the direction X from the forming apparatus 10 and is disposed between the first handling device 6 and the cutting device 3. Accordingly, it is possible to dispose the second handling device 7 such that the second handling device 7 does not obstruct the metal pipe 80 transported by the other gas supply mechanism 40 of the forming apparatus 10.

Moreover, the forming system 1 includes the wall 5 which is provided on the other side in the direction X from the forming apparatus 10, and the gas supply source 4 which is disposed on the other side in the direction X from the wall 5 and supplies gas to the gas supply mechanism 40. Accordingly, the wall 5 can be disposed on the sides opposite to the preliminary forming apparatus 2 and the cutting device 3 in the state where the forming apparatus 10 is interposed therebetween, and it is possible to decrease the distance between the wall 5 and the forming apparatus 10 in the direction X. Accordingly, it is possible to further decrease the site area of the forming system 1.

Configuration of Forming System According to Another Embodiment

Figure 9:
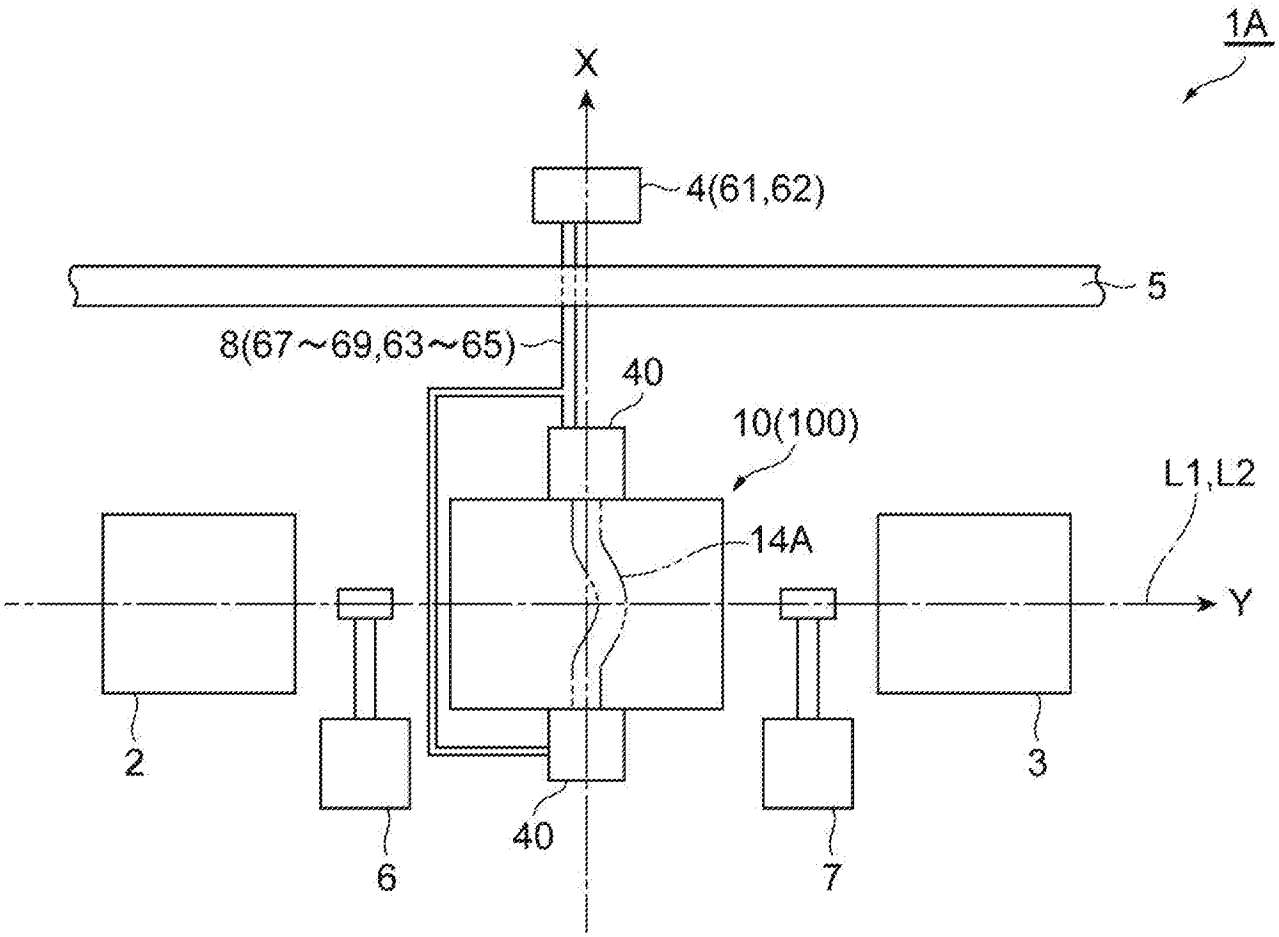
FIG. 9 is a schematic plan view of the forming system according to another embodiment of the present invention.

FIG. 9 is a schematic plan view of the forming system according to another embodiment of the present invention. As shown in FIG. 9, compared to the forming system 1 shown in FIG. 1 and a forming system 1A according to another embodiment, the positional relationships among the preliminary forming apparatus 2, the forming apparatus 10, the cutting device 3, the first handling device 6, the second handling device 7, and the path 8 are different from each other.

The preliminary forming apparatus 2, the forming apparatus 10, and the cutting device 3 are disposed in this order in the direction Y. That is, the forming apparatus 10 is interposed between the preliminary forming apparatus 2 and the cutting device 3 in the direction Y. More specifically, the preliminary forming apparatus 2 is disposed on one side in the direction Y from the forming apparatus 10, and the cutting device 3 is disposed on the other side in the direction Y from the forming apparatus 10. Accordingly, the region between the preliminary forming apparatus 2 and the forming apparatus 10 becomes a linear transport path of the metal pipe material 14A which extends in the direction Y, and the region between the forming apparatus 10 and the cutting device 3 becomes a linear transport path of the metal pipe 80 which extends in the direction Y. Here, the first straight line L1 which connects the preliminary forming apparatus 2 and the forming apparatus 10 to each other and the second straight line L2 which connects the forming apparatus 10 and the cutting device 3 to each other are the same as each other in the direction Y. That is, the first straight line L1 becomes the transport path of the metal pipe material 14A and the second straight line L2 becomes the transport path of the metal pipe 80.

The first handling device 6 is disposed on the one side in the direction X from the forming apparatus 10 and is disposed between the preliminary forming apparatus 2 and the forming apparatus 10. More specifically, the first handling device 6 is disposed on the one side in the direction X from the forming apparatus 10 and is disposed on the one side in the direction Y from the forming apparatus 10. The second handling device 7 is disposed on the one side in the direction X from the forming apparatus 10 and is disposed between the forming apparatus 10 and the cutting device 3. More specifically, the second handling device 7 is disposed on the one side in the direction X from the forming apparatus 10 and is disposed on the other side in the direction Y from the forming apparatus 10.

The pair of gas supply mechanisms 40 and 40 including the forming apparatus 10 are disposed in the direction X in the state where the center of the forming apparatus 10 is interposed therebetween. The pair of gas supply mechanisms 40 and 40 are not disposed in the region between the preliminary forming apparatus 2 and the forming apparatus 10 which is the transport path of the metal pipe material 14A, and in the region between the forming apparatus 10 and the cutting device 3 which is the transport path of the metal pipe 80. That is, each of the pair of gas supply mechanisms 40 and 40 is not disposed on the first straight line L1 and the second straight line L2.

According to the forming system 1A of another embodiment, the preliminary forming apparatus 2, the forming apparatus 10, and the cutting device 3 are disposed in this order in the direction Y, and the pair of gas supply mechanisms 40 and 40 including the forming apparatus 10 are disposed in the direction X orthogonal to the direction Y in the state where the center of the forming apparatus 10 is interposed therebetween. Accordingly, since the pair of gas supply mechanisms 40 and 40 are not disposed on the transport path of the metal pipe material 14A and the pair of gas supply mechanisms 40 and 40 are not disposed on the transport path of the metal pipe 80, the pair of gas supply mechanisms 40 and 40 do not obstruct the metal pipe 80 which is transported from the forming apparatus 10 to the cutting device 3. In addition, the pair of gas supply mechanisms 40 and 40 can be arranged n the direction X, the preliminary forming apparatus 2, the forming apparatus 10, and the cutting device 3 can be arranged in the direction Y, and it is possible to decrease the site area of the forming system 1A.

Moreover, since the preliminary forming apparatus 2, the forming apparatus 10, and the cutting device 3 are disposed in this order in the direction Y, a series of preliminary forming processing, forming processing, and cutting process can be sequentially and continuously performed on the metal pipe material 14A (metal pipe 80).

Hereinbefore, preferred embodiments of the present invention are described. However, the present invention is not limited to the above-described embodiments. For example, in the embodiments, the forming apparatus 10 may not necessarily have the heating mechanism 50. The metal pipe material 14A may be heated before it is installed in the forming apparatus 10. In this case, the pipe holding mechanism 30 may not be configured of the first electrode 17 and the second electrode 18.

In addition, in the above-described embodiments, both of the pair of gas supply mechanisms 40 and 40 may not be connected to the gas supply source 4, and one of the pair of gas supply mechanisms 40 and 40 may be connected to the gas supply source 4. In this case, any one of the pair of gas supply mechanisms 40 and 40 may be configured so as to discharge high-pressure gas.

In addition, in the embodiment, the pair of gas supply mechanisms 40 and 40 are provided in the direction Y in the state where the center of the forming apparatus 10 is interposed therebetween. In another embodiment, the pair of gas supply mechanisms 40 and 40 are provided in the direction X in the state where the center of the forming apparatus 10 is interposed therebetween. However, the pair of the gas supply mechanisms 40 and 40 can be one gas supply mechanism. That is, the gas supply mechanism 40 is separated from the center of the forming apparatus 10 and is provided in the direction X or the direction Y.

In addition, in the embodiments, the flange sections are provided on the metal pipes 80 and 90. However, the forming systems 1 and 1A can be applied to the case where a metal pipe in which the flange sections are not provided is formed.

It should be understood that the invention is not limited to the above-described embodiment, but may be modified into various forms on the basis of the spirit of the invention. Additionally, the modifications are included in the scope of the invention.

What is claimed is:

1. A forming system for forming a metal pipe by expanding a metal pipe material in a die, comprising:

a preliminary forming apparatus configured to preliminarily form and heat the metal pipe material;

a forming apparatus which includes:

a first gas supply unit configured to supply gas into the preliminarily-formed metal pipe material to expand the metal pipe material;

a second gas supply unit configured to supply gas into the preliminarily-formed metal pipe material; and a main body portion to which the die is attached;

a cutting device configured to cut at least a portion of the formed metal pipe; and a path connected to the first gas supply unit and the second gas supply unit, wherein the first gas supply unit is provided so as not to be disposed on a first straight line which connects the preliminary forming apparatus and the main body portion in a plan view and a second straight line which connects the cutting device and the main body portion in the plan view, wherein directions orthogonal to each other with respect to a center of the forming apparatus are a first direction and a second direction, the preliminary forming apparatus and the entire cutting device are disposed on one side in the second direction from the forming apparatus, wherein the preliminary forming apparatus is disposed on one side in the first direction from the forming apparatus, wherein the entire cutting device is disposed on the other side in the first direction from the center of the forming apparatus, and wherein the first gas supply unit and the second gas supply unit are provided in the first direction in a state where the center of the forming apparatus is interposed between the first gas supply unit and the second gas supply unit.

2. The forming system according to claim 1, further comprising:

a handling device configured to transport the metal pipe material from the preliminary forming apparatus to the forming apparatus, wherein the handling device is disposed on the one side in the first direction from the forming apparatus, and is disposed between the preliminary forming apparatus and the cutting device.

3. The forming system according to claim 1, wherein each of the first gas supply unit and the second gas supply unit is separated from the center of the forming apparatus and is provided in the first direction.

4. The forming system according to claim 1, further comprising:

a wall which is provided on the other side in the second direction from the forming apparatus; and a gas supply source which is provided on the other side in the second direction from the forming apparatus and supplies the gas to the first gas supply unit through the path.

5. A forming system for forming a metal pipe by expanding a metal pipe material in a die, comprising:

a preliminary forming apparatus configured to preliminarily form and heat the metal pipe material;

a forming apparatus which includes:

a gas supply unit configured to supply gas into the preliminarily-formed metal pipe material to expand the metal pipe material; and a main body portion to which the die is attached;

a cutting device configured to cut at least a portion of the formed metal pipe;

a first handling device between the preliminary forming apparatus and the forming apparatus;

a second handling device between the forming apparatus and the cutting device; and a path connected to the gas supply unit, wherein the gas supply unit is provided so as not to be disposed on a first straight line which connects the preliminary forming apparatus and the main body portion in a plan view and a second straight line which connects the cutting device and the main body portion in a plan view, wherein directions orthogonal to each other with respect to a center of the forming apparatus are the first direction and the second direction, the gas supply unit is separated from a center of the forming apparatus and is provided in the first direction, wherein the preliminary forming apparatus, the forming apparatus, and the cutting device are disposed in the second direction, wherein the first handling device is disposed on one side in the first direction from the forming apparatus, and wherein the second handling device is disposed on the other side in the first direction from the forming apparatus.

* * * * *